US007461456B2

(12) United States Patent
Tsushio et al.

(10) Patent No.: US 7,461,456 B2
(45) Date of Patent: Dec. 9, 2008

(54) DRY SHAVER

(75) Inventors: Toshiyuki Tsushio, Hikone (JP); Jyuzaemon Iwasaki, Nagahama (JP); Takeshi Shiba, Hikone (JP); Masanobu Yamasaki, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 234 days.

(21) Appl. No.: 11/013,447

(22) Filed: Dec. 17, 2004

(65) Prior Publication Data

US 2005/0138821 A1 Jun. 30, 2005

(30) Foreign Application Priority Data

Dec. 26, 2003 (JP) ..... 2003-435220

(51) Int. Cl.
*B26B 19/04* (2006.01)

(52) U.S. Cl. ..... 30/43.92; 30/34.1; 30/527

(58) Field of Classification Search ..... 30/43.91–43.92, 30/527, 531, 528, 529, 532
See application file for complete search history.

(56) References Cited

U.S. PATENT DOCUMENTS 3,081,540 A * 3/1963 Yoshida ..... 30/41.6
3,521,093 A * 7/1970 Harms ..... 310/19
3,858,314 A * 1/1975 Brenneman et al. ..... 30/43.92
3,973,323 A * 8/1976 Trees ..... 30/43.92
4,003,131 A * 1/1977 Groothuis ..... 30/43.92
5,159,755 A * 11/1992 Jestadt et al. ..... 30/43.92
5,367,771 A * 11/1994 Mukai ..... 30/43.92
5,551,154 A * 9/1996 Tanahashi et al. ..... 30/43.92
5,787,593 A * 8/1998 Althaus ..... 30/527
5,953,824 A * 9/1999 Ferraro et al. ..... 30/527
6,073,348 A * 6/2000 Shiba ..... 30/34.1
6,115,924 A * 9/2000 Oldroyd ..... 30/527
6,151,780 A * 11/2000 Klein ..... 30/43.92
6,308,414 B1 * 10/2001 Parsonage et al. ..... 30/43.91
6,684,509 B1 * 2/2004 Best et al. ..... 30/43.92
2002/0104223 A1 * 8/2002 Oldroyd ..... 30/532
2004/0128834 A1 * 7/2004 Royle ..... 30/43.92
2004/0163260 A1 * 8/2004 Uchiyama ..... 30/43.92
2004/0237310 A1 * 12/2004 Shiba et al. ..... 30/43.92

FOREIGN PATENT DOCUMENTS

EP 0 239 920 A2 3/1986
GB 2 266 070 A 10/1993
JP 05-200166 A1 8/1993
WO WO-03/041918 A1 5/2003
WO WO 2004/030874 * 4/2004

* cited by examiner

*Primary Examiner*—Boyer D. Ashley
*Assistant Examiner*—Laura M. Lee
(74) *Attorney, Agent, or Firm*—Cheng Law Group PLLC

(57) ABSTRACT

A dry shaver includes a swingable shaving head which is provided with a pair of support points through which the shaving head is supported to a grip through a linkage mechanism. The linkage mechanism includes a pair of cranks each connected at its one end to each one of the support points and connected at the other end to each one of the anchor points on the side of the grip. A frame projects on top of the grip in an overlapping relation with the shaving head to give the anchor points which are positioned upwardly of the support points with respect to a height axis of the grip for suspending the shaving head an top of the grip by the frame.

12 Claims, 11 Drawing Sheets

DRY SHAVER

TECHNICAL FIELD

The present invention is directed to a dry shaver, and more particularly a dry shaver with a swingable shaving head.

BACKGROUND ART

A dry shaver having a swingable shaving head is known in the art, for example, from EP 0 239 920 A2 in which the shaving head is caused to swing or tilt by contact with a user's skin to follow a contour of the skin while manipulating to move the shaver across the skin. For this purpose, the shaving head is pivotally connected at its top end to a frame projecting on a hand grip by means of pivot pins. In this structure, the pivot pins or the associated portions of the frame have to be exposed at the top end of the shaving head very close to the cutting face of the shaving head, thus hindering the shaving operation.

In order to alleviate the problem, JP 5-200166 A proposes another dry shaver in which the shaving head is supported by use of a four bar linkage mechanism. The four bar linkage mechanism enables to eliminate the use of pivot pins and the associated parts projecting on top of the shaving head, and allows the shaving head to swing to follow the skin, while retaining an advantage of keeping an pseudo swing axis as close as to the top end of the shaving head such that the shaving head can swing with a minimum attendant displacement of the point of contact with the skin. The four bar linkage mechanism includes a pair of side links or cranks each of which is pivotally connected at its opposite ends to the shaving head and to the hand grip to constitute a double-crank mechanism. The shaving head is given support points for pivotal connection respectively with the upper ends of the individual cranks, while the hand grip is formed with anchor points for pivotal connection respectively with the lower ends of the individual cranks. Even with the use of the linkage mechanism in which the support points to the shaving head is disposed upwardly of the anchor points to the hand grip, however, there remains a problem in that the contact point of the cutting face with the skin suffers from a considerable vertical displacement away from the skin, which makes it difficult to maintain an optimum and comfortable contacting pressure with the skin.

Further, since the above linkage mechanism gives an inherent swinging characteristic that the shaving head swings only accompanied with a small angular displacement of the cranks about the anchor points, the shaving head becomes oversensitive to a force applied to swing the shaving head. In other words, a slight pressing force might swing the shaving head far beyond a suitable position through the small angular displacement of the cranks. Such jerky movement is therefore to be avoided in order to make the shaving head to follow the skin smoothly in an optimum pressing relation with the skin.

DISCLOSURE OF THE INVENTION

In view of the above problems, the present invention has been achieved to provide a dry shaver with a swingable shaving head which is capable of following a user's skin smoothly while keeping an optimum pressing relation with the skin. The shaver in accordance with the present invention includes a grip having a height axis, and a shaving head mounted on top of the grip with respect to the height axis. The shaving head has a cutting face on its top and has a pair of support points through which the shaving head is supported to the grip. A linkage mechanism is provided to couple the shaving head to the grip for allowing the shaving head to swing relative to the grip. The linkage mechanism includes a pair of cranks each connected at its one end to each one of the support points and connected at the other end to each one of the anchor points on the side of the grip. An important feature of the dry shaver resides in that a frame projects on top of the grip in an overlapping relation with the shaving head to give the anchor points which are positioned upwardly of the support points with respect to the height axis for suspending the shaving head on top of the grip by the frame. With the employment of the above linkage mechanism, the shaving head is enabled to swing only accompanied with a small vertical displacement of the cutting face from the skin, but with a sufficient angular displacement of the cranks about the anchor points, thereby keeping an optimum contacting pressure against the skin, yet swinging the shaving head to smoothly follow the skin, all of which assure a comfortable and effective shaving performance.

Preferably, the support points are spaced from each other by a coupler distance (C) greater than a frame distance (F) between the anchor points. In this connection, the coupler distance may be selected to be at least 1.5 times of the frame distance (F). Also, it is preferred that the cranks are angled with each other at an angle of of 30° to 120° when the shaving head is kept in an upright position.

Further, it is preferred that at least one of the cranks is slidably and pivotably connected to at least one of the anchor point and the support point in order to give more delicate swinging motion to the shaving head.

In a preferred embodiment, the grip incorporates a slider that carries the frame. The slider is movable along the height axis relative to the grip and is spring-biased upwardly for floatingly supporting the shaving head to the grip. Thus, the shaving head is given a combined motion of the swinging and the sinking for more smooth contact with the skin at a desired contacting pressure.

The shaving head may be also given a spring bias against which the shaving head swings relative to the grip so as to add a suitable skin contact pressure to the swinging shaving head, as well as to return the shaving head in the upright or neutral position upon being released from the skin.

The shaver may be configured to define the anchor points spaced from each other in a width direction along which the cutting face of the shaving head is elongated, or alternatively spaced from each other in a thickness direction of the elongated cutting face.

These and still other advantageous features of the present invention will become more apparent from the following detailed explanation of the preferred embodiments when taken in conjunction with the attached drawings.

BEST MODES FOR CARRYING OUT THE INVENTION

Figure 3:
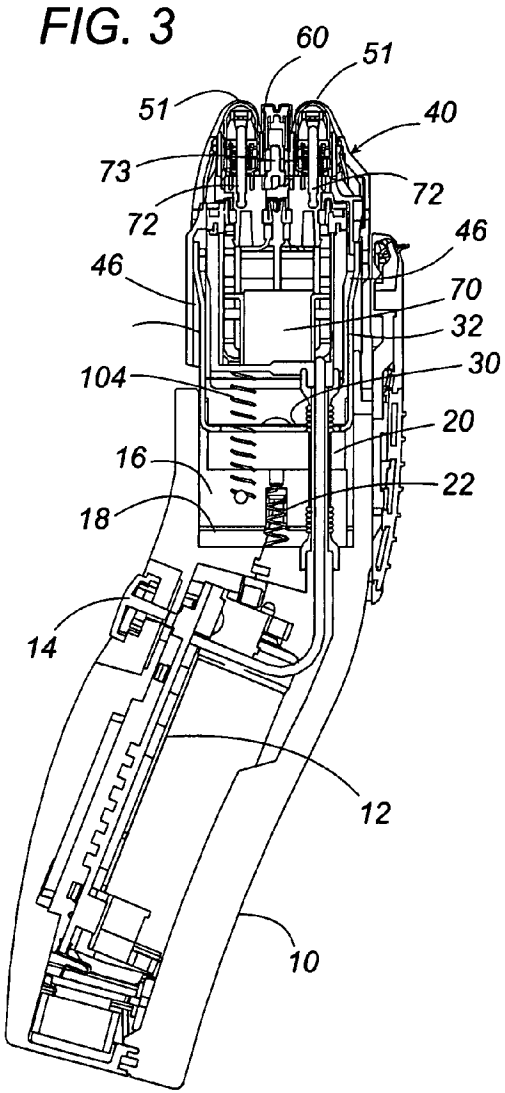
FIG. 3 is a side vertical section of the shaver.
Figure 2:
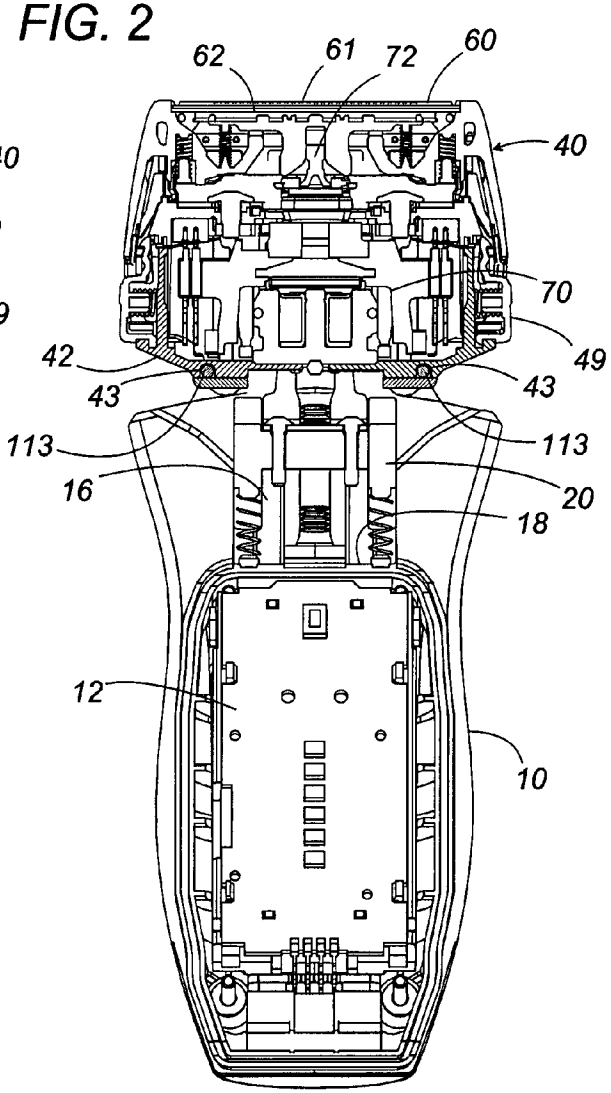
FIG. 2 is a front vertical section of the shaver.
Figure 1:
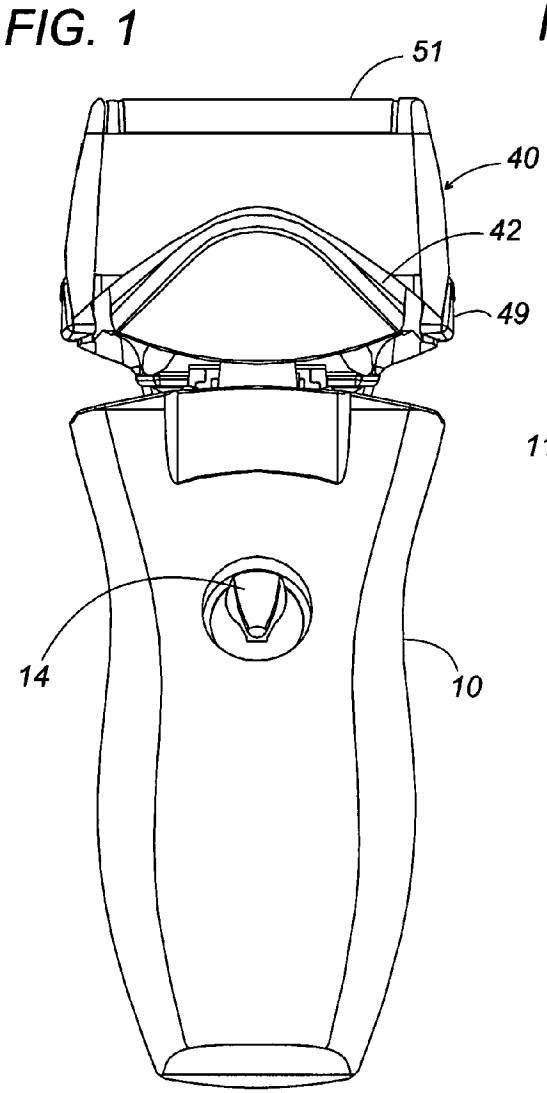
FIG. 1 is a front view of a dry shaver in accordance with a preferred embodiment of the present invention.

Referring now to FIGS. 1 to 4, there is shown a dry shaver in accordance with a preferred embodiment of the present invention. The shaver is basically composed of an elongated grip 10 with a height axis shaped to be grasped by a user' hand, and a shaving head 40 mounted on top of the grip 10 to be swingable relative thereto. The grip 10 accommodates therein a chassis 12 carrying electronic components forming a power supply and a switch actuated by a button 14 on the exterior of the grip 10. Formed in the upper end of the grip 10 is a top-opened cavity 16 with a closed bottom 18 for receiving therein a slider 20 which carries a frame 30 supporting the shaving head 40. The slider 20 is slidable along the height axis and is biased upwardly by springs 22 interposed between the lower end of the slider and the bottom 18 of the cavity 16 for floatingly supporting the shaving head 40 on top of the grip 10. The frame 30 projects on top of the grip 10 and includes a pair of props 32 which are spaced in a thickness direction of the grip 10 for connection to front and rear ends of the shaving head 40 by means of a linkage mechanism 100 by which the shaving head 40 is allowed to swing relative to the grip 10 about a swing axis running in the thickness direction of the shaving head 40, as will be explained in detail.

The shaving head 40 is elongated to have a lengthwise axis and is composed of a cradle case 42 which mounts a detachable shell 50 carrying two outer arcuate shearing foils 51 and one center cutting unit 60 composed of an elongated outer cutter 61 and an inner cutter 62. Release buttons 49 are provided on opposite ends of the cradle case 42 for releasably holding the shell 50. The cradle case 42 is also configured to accommodate therein a linear actuator 70 with two output shafts 72 connected to reciprocate inner cutters 52 relative to the outer shearing foils 51 as well as the inner cutter 62 of the center cutting unit 60. The case 42 has its top opening closed by a plate 46 through which the output shafts 72 extend for detachable connection with the inner cutters 62. One of the output shafts 72 is formed with an auxiliary shaft 73 for connection to the inner cutter 62 of the center cutting unit 60. The outer shearing foils 51 and the outer cutter 61 are exposed on top of the shaving head 40 to give a general cutting face for contact with a user's skin. A flexible tube 47 extends from the bottom of the case 42 through the frame 30, the slider 20 and through the bottom 18 of the cavity 16 to seal leads 71 which feeds a current from the power supply to the actuator 70. Upon being energized, the actuator 70 drives the inner cutters to reciprocate for hair shaving.

Figure 4:
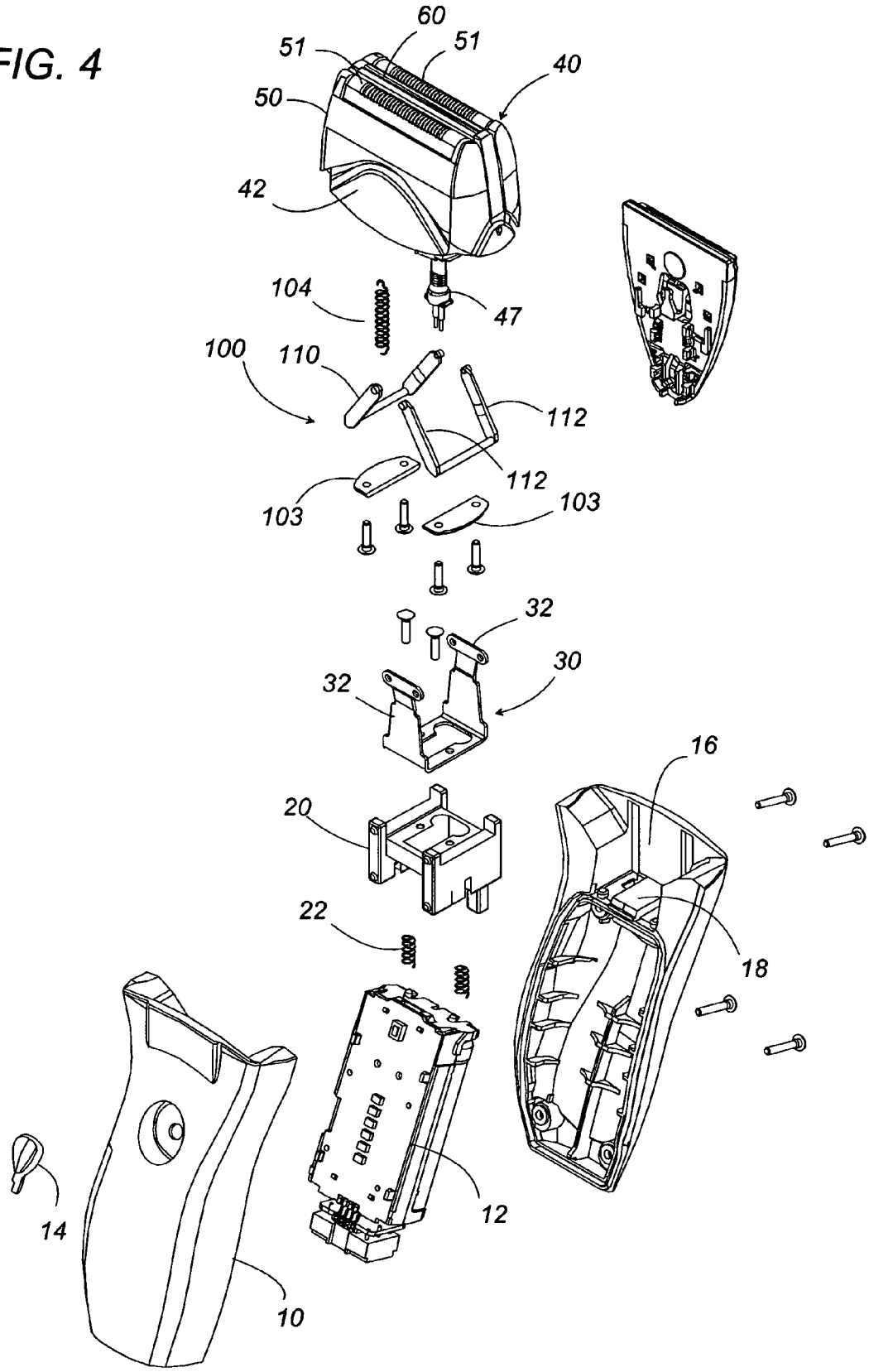
FIG. 4 is an exploded perspective view of the shaver.
Figure 5:
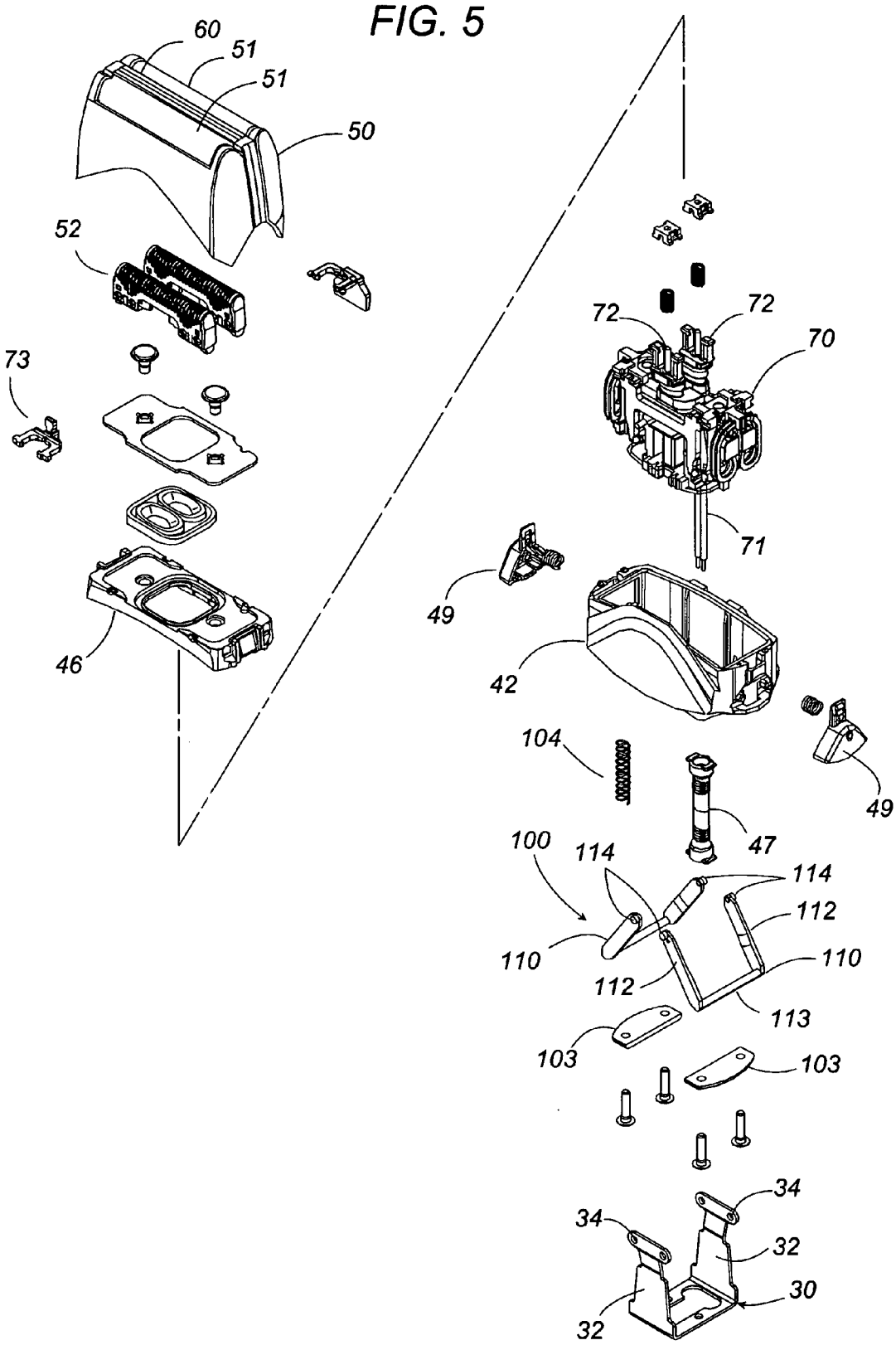
FIG. 5 is an exploded perspective view of a shaving head of the shaver.

As shown in FIGS. 4 and 5, the linkage mechanism 100 includes a pair of U-shaped cranks 110 each having two side links 112 interconnected at their lower ends with a support axle 113. Each side link 112 is formed at its upper end with an anchor pin 114 which fits into a pivot hole 34 at the top end of the prop 32 of the frame 30 such that each of the cranks 110 can swivel about a horizontal axis at a connection to the upper end of the frame 30. The support axles 113 of the cranks 110 are fitted respectively into pivot grooves 43 in the bottom of the case 42 such that each crank 110 can also swivel about a horizontal axis at a connection to the lower end of the case 42. The axles 113 are retained at the bottom of the case 42 respectively by backing seats 103 secured to the case 42. For better understanding of the swinging motion of the shaving head 40, the pivotal connections of the cranks 110 to the frame 30 are referred to as anchor points on the side of the grip 10, while the pivotal connection of the cranks 110 to the shaving head 40 are referred to as support points on the side of the shaving head 40.

Figure 6:
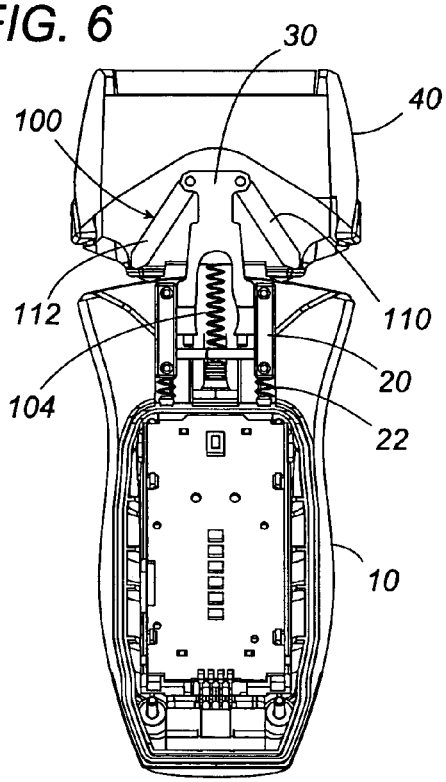
FIGS. 6 to 9 are schematic views respectively illustrating the shaving head in different operating positions.
Figure 8:
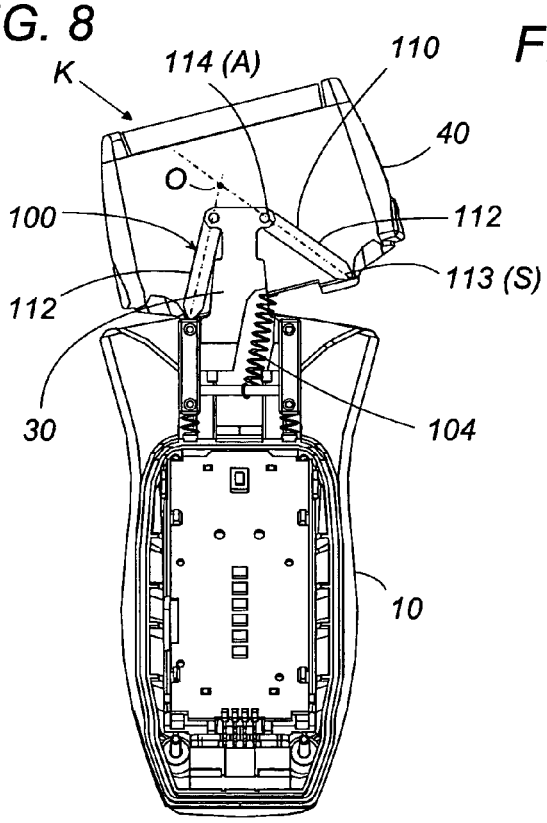
Figure 9:
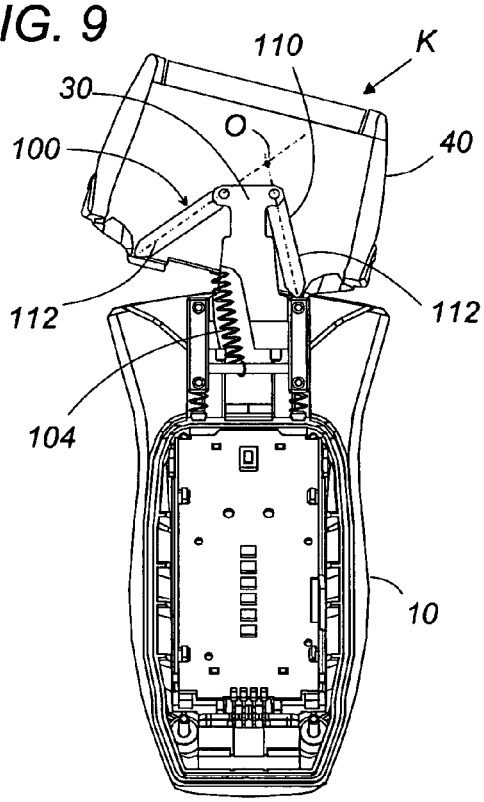
Figure 10:
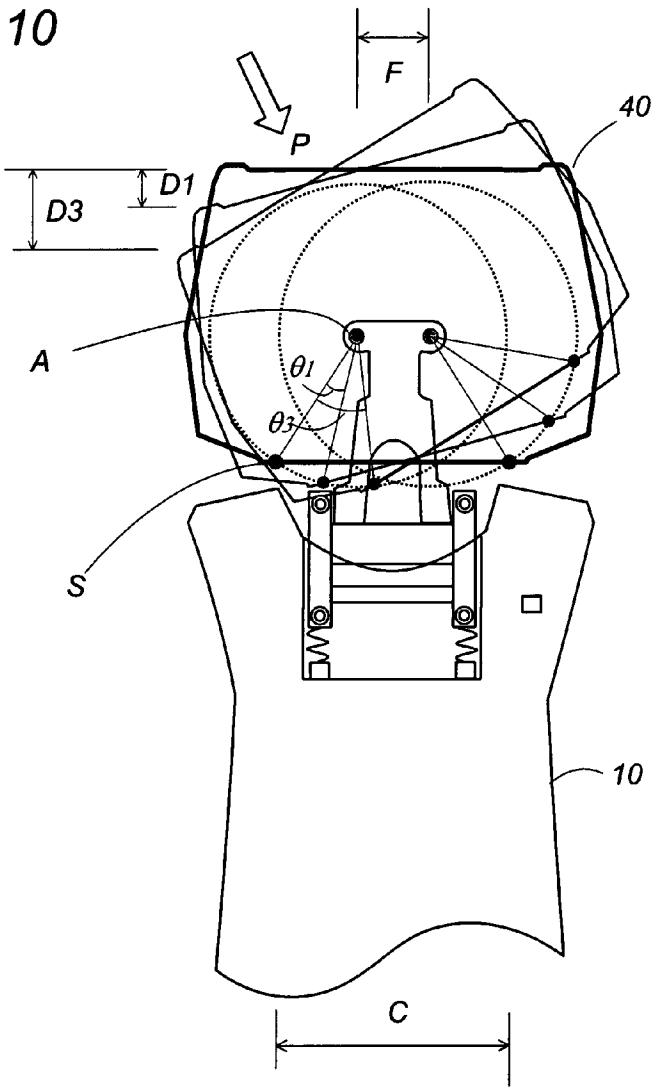

The two cranks 110 constitute a double-crank mechanism in which the upper end of the prop 32 gives a frame bar between the anchor points(A), and the bottom of the case 42 gives a coupler bar between the support points (S), and in which the frame bar (frame distance) (F) is shorter than the coupler bar (coupler distance) (C), as indicated in FIG. 10. Thus, the shaving head 40 is suspended from the frame 30 by means of the double-crank mechanism so as to be allowed to swing on top of the grip 10. A coil spring 104 interconnects the shaving head 40 and the slider 20 to give a spring bias against which the shaving head 40 swings relative to the grip 10, as shown in FIGS. 8 and 9. The coupler distance (C) is set to be at least 1.5 times the frame distance (F), and the cranks 110 are angled with each other at an angle of 30° to 120° at an upright position of FIG. 6, i.e., a neutral position to which the shaving head 40 returns in the absence of an external force. The props 32 projecting from the upper end of the grip 10 in an overlapping relation with the shaving head 40 are received together with the side links 112 into corresponding slits 46 formed in the front and rear faces of the case 42 to be concealed within the shaving head 40.

Figure 7:
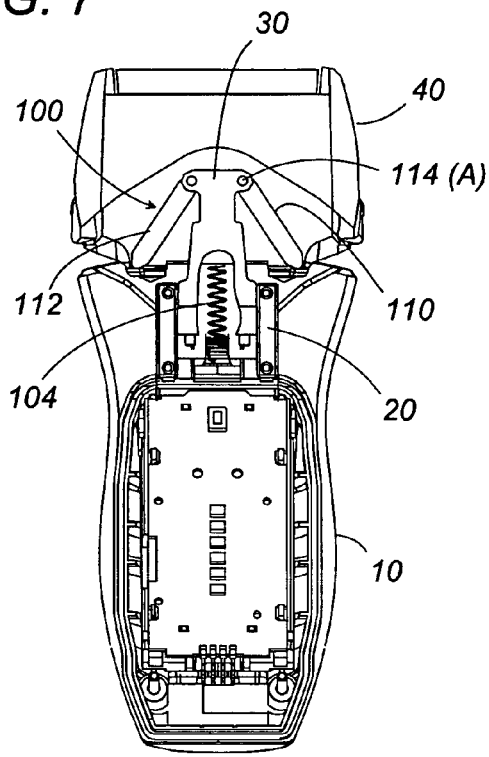

With the combination of the double-crank linkage mechanism and the floating mounting structure, the shaving head 40 can be simply depressed to a position of FIG. 7, and also can swing or tile to either direction with or without being accompanied with the sinking movement, as shown in FIGS. 8 and 9, while the shaving head 40 is manipulated to move across the user's skin as being pressed against the skin. As seen in FIGS. 8 and 9, the above double-crank mechanism 100 gives an instantaneous pseudo swing center (O) at a crossing point of extension lines to the side links 112, which is located adjacent to the top cutting face and about which the shaving head 40 swings. With this consequence, the shaving head 40 can be given a self-locking capability of ceasing a further swinging movement when a force K applied to shaving head along a direction aligned with the extension line of one side link 112 making a larger angular displacement.

Further, since the above double-crank mechanism 100 is specifically adapted to have the anchor points (A) located upwardly of the support points (S) with respect to the height axis of the grip 10, it gives a specific swinging motion to the shaving head 40 suitable to follow the skin only with a minimum of lateral and vertical displacement with regard to a point of contact with the skin and therefore to keep the contacting pressure at a suitable level. Such specific swinging motion can be well understood with reference to FIG. 10, in contrast to a possible implementation of FIG. 11 which is analogous to the structure disclosed in JP 5-200166 A and has the support points (S) upwardly of the anchor points (A) for lifting the shaving head 40X on top of the grip 10X. For easy comparison between the swinging movement of the present invention of FIG. 10 and that of the possible implementation of FIG. 11, the shaving heads 40 and 40X are shown at the same inclinations.

Upon receiving a force at a contact point P as indicated by arrows in the figures, both of shaving heads 40 and 40X are caused to swing through the angular displacements of the cranks of the linkage mechanism. When the shaving head swings to a small extent, contact point P sees a vertical displacement D1 for the shaving head 40 of FIG. 10, while the contact point P of shaving head 40X of FIG. 11 sees a greater vertical displacement D2 (D2>D1). As the shaving heads further swing to a large extent, contact point P sees a vertical displacement D3 for the shaving head 40 of FIG. 10, while contact point P of shaving head 40X of FIG. 11 sees again a greater vertical displacement D4 (D4>D3). From this simple comparison, it is easily confirmed that the linkage mechanism of the present invention can minimize the vertical displacement of the contact point away from the skin during the swinging movement.

Figure 11:
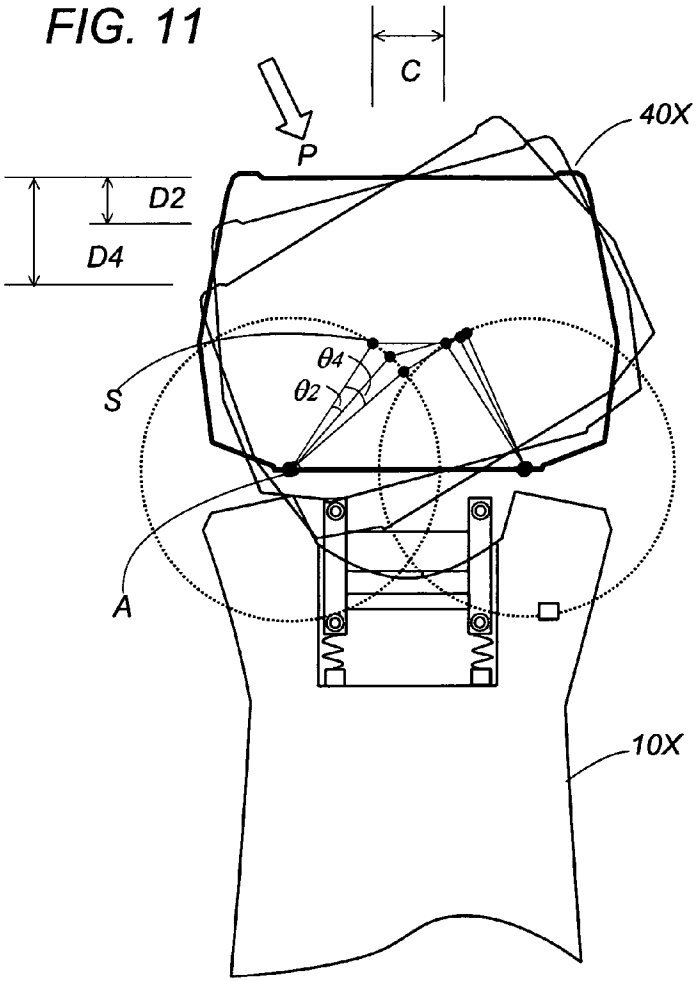
FIGS. 10 and 11 are schematic views demonstrating the characteristic swinging movement of the present invention in contrast to another possible arrangement.

Also, when swinging to the same inclinations, the shaving head 40 of FIG. 10 is accompanied by angular displacements ($\theta 1$, $\theta 3$) of crank, which are considerably greater than the corresponding angular displacements ($\theta 2$, $\theta 4$) that the crank of the shaving head 40X of FIG. 11 makes ($\theta 1 > \theta 2$, $\theta 3 > \theta 4$). Thus, the shaving head 40 swings over a larger angle of the crank than the shaving head 40X with an attendant smoothness, i.e., without accompanied with an overshooting motion which would be otherwise seen for the shaving head 40X that swings only through smaller angular displacements ($\theta 2$, $\theta 3$) of the crank. Accordingly, the shaving head 40 can smoothly swing to a desired inclination without suffering from jerky and overshooting movement by use of the above linkage mechanism of suspending the shaving head 40 on top of the grip 10.

Further, it is easily confirmed by comparison of the diagrams of FIGS. 10 and 11, the shaving head 40 can swing over a wide range, while the shaving head 40X suffers from a dead point soon after the left-hand crank rotates beyond angle $\theta 4$, where the left-hand crank becomes aligned with a coupler arm connecting the two support points (S) on the shaving head 40X to permit no further actual swinging movement. Thus, the above linkage mechanism allows the shaving head 40 to swing over a wide range without being jammed.

Figure 12:
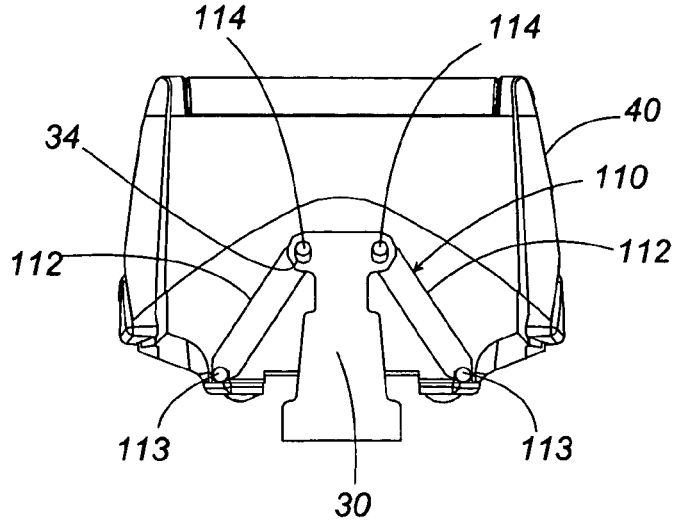
FIGS. 12 to 14 are schematic views respectively illustrating the shaving head in different positions in accordance with a modification of the above embodiment.
Figure 13:
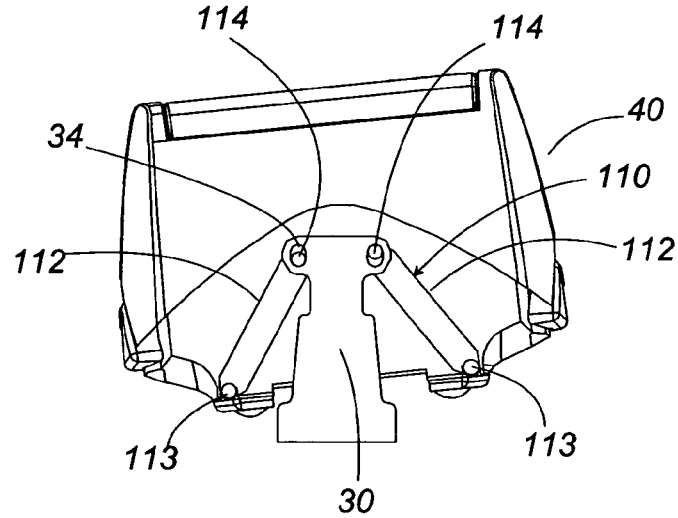
Figure 14:
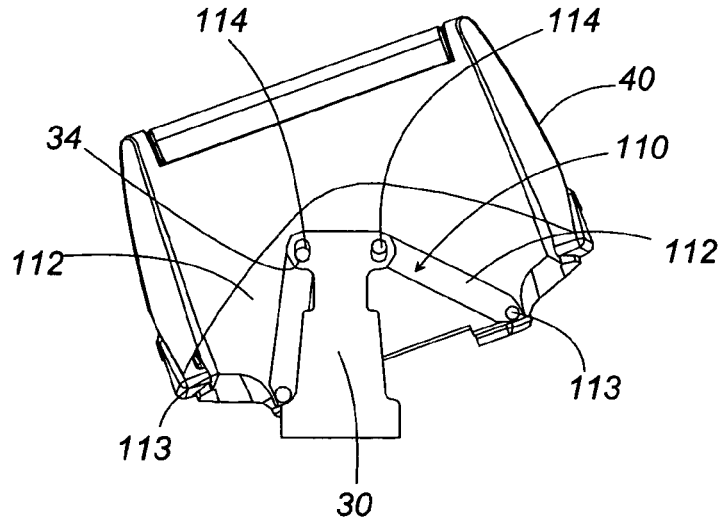

As shown in FIGS. 12 to 13, the frame 30 may be configured to have vertically elongated pivot holes 34 for allowing the anchor pin 114 of each side link 112 to slide vertically to some extent within the pivot hole 34. With the addition of the sliding movement to the pivot movement, the side links 112 or the cranks 110 of the linkage can give more sophisticated swinging movement to the shaving head 40.

Figure 17:
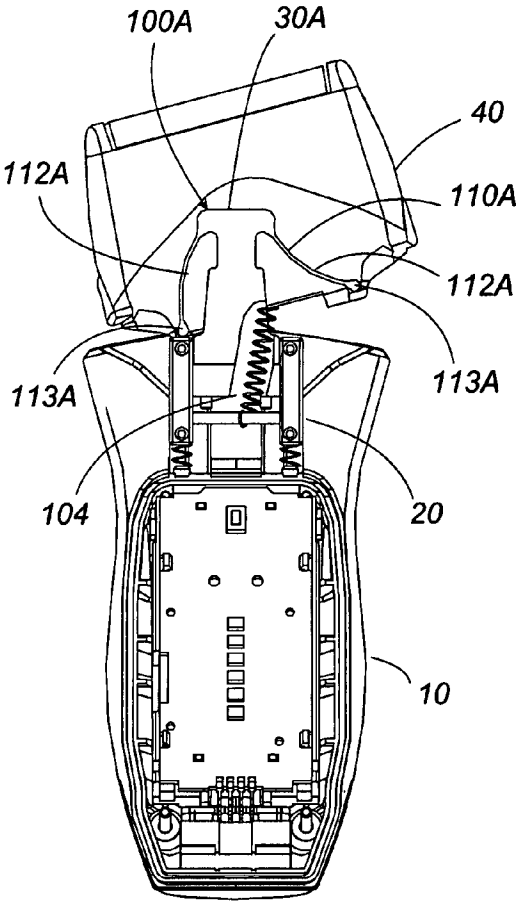
FIGS. 15 to 17 are schematic views respectively illustrating the shaving head in different positions in accordance with another embodiment of the present invention.
Figure 16:
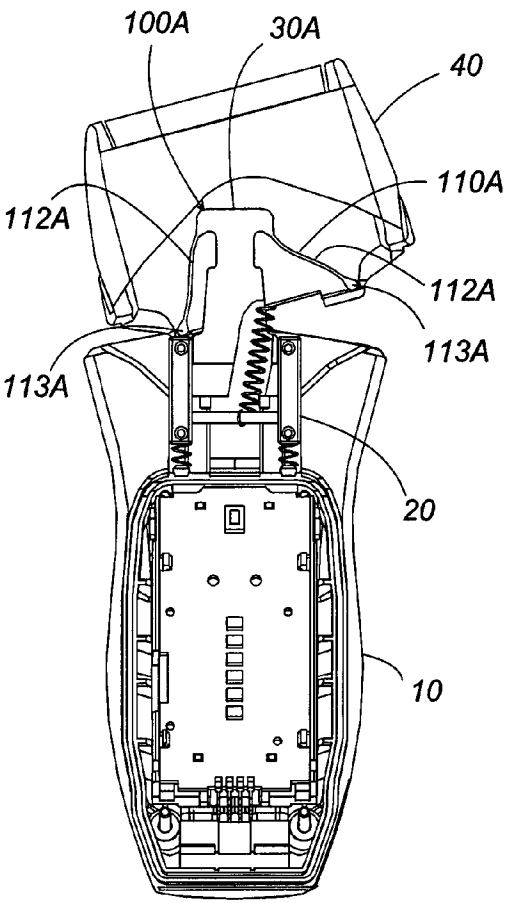
Figure 15:
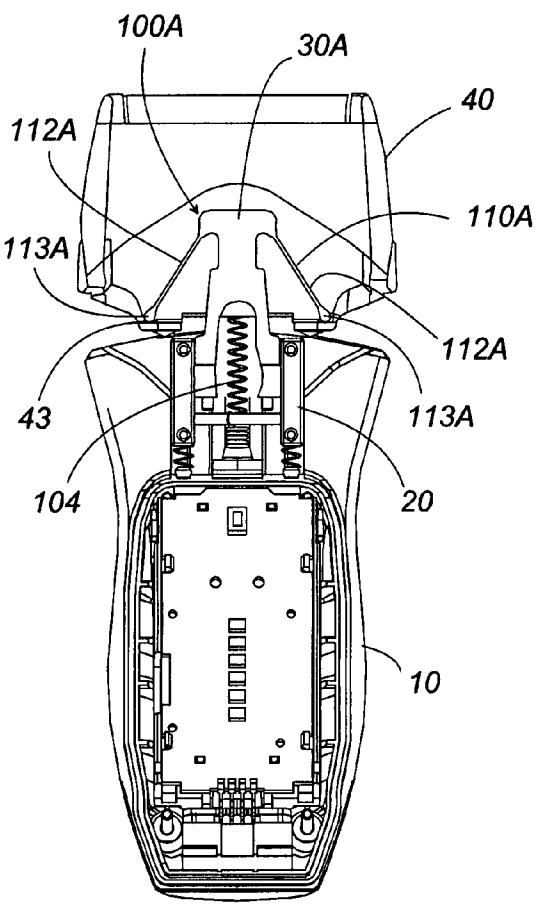

FIGS. 15 to 17 illustrate another embodiment of the present invention which is basically identical to the above embodiment except that the cranks 110A are integrally formed with the frame 30A as resiliently deformable members. Like parts are designated by like reference numerals and no duplicate explanation is deemed necessary. The crank 110A is molded together with the frame 30A to have resiliently deformable side links 112A and support axles 113A also molded integrally to connect the lower ends of the side links 112A. The support axles 113A are received respectively into the pivot grooves 43 at the bottom of the shaving head 40 to define thereat the support points about which the side links are allowed to pivot respectively. The upper ends of the side links 112A merge respectively into the opposite sides of the frame 30A to define thereat the anchor points at which the side links are allowed to deform resiliently. The resilient deformation of the side links 112A is combined with the pivotal movement about the support points to allow the shaving head 40 to swing to the inclined positions of FIGS. 16 and 17, in an analogous manner as in the previous embodiment, yet accompanied with the resilient deformation of the side links 112A. The integration of the cranks 110A into the frame 30A is advantageous for reducing the number of components and therefore facilitating the assembly of the shaver. Alternatively, the cranks 110A may be integrated into the shaving head 40 or even into both of the frame and the shaving head.

Figure 18:
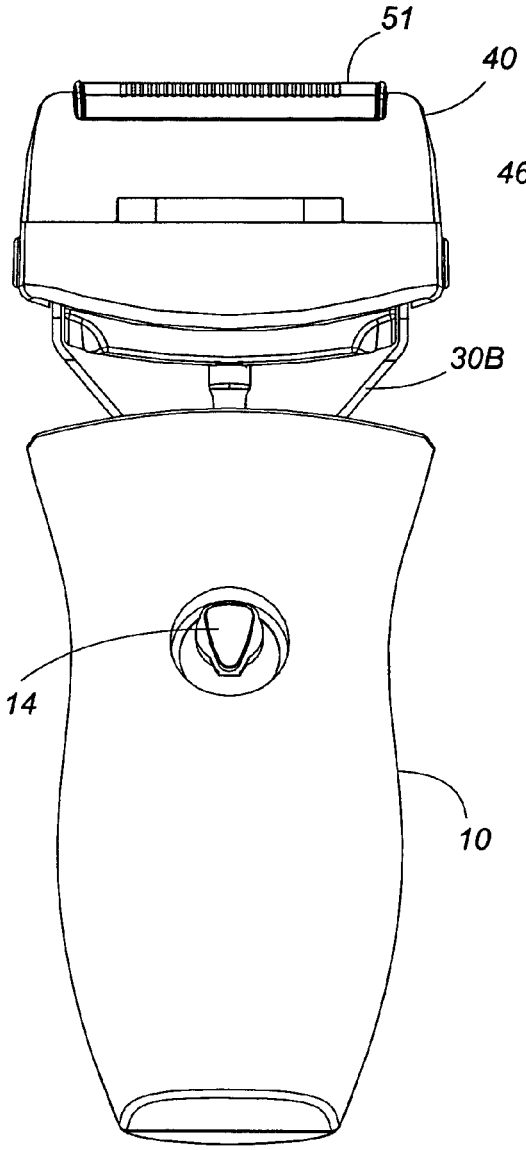
FIG. 18 is a front view of a dry shaver in accordance with a further embodiment of the present invention.
Figure 19:
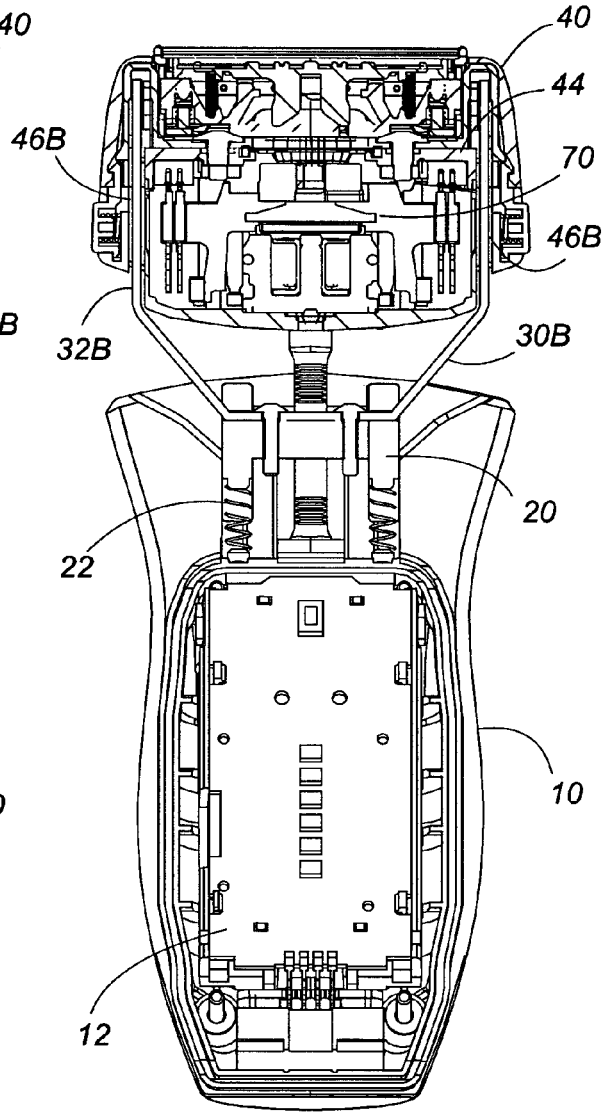
FIG. 19 is a front vertical section of the shaver.
Figure 20:
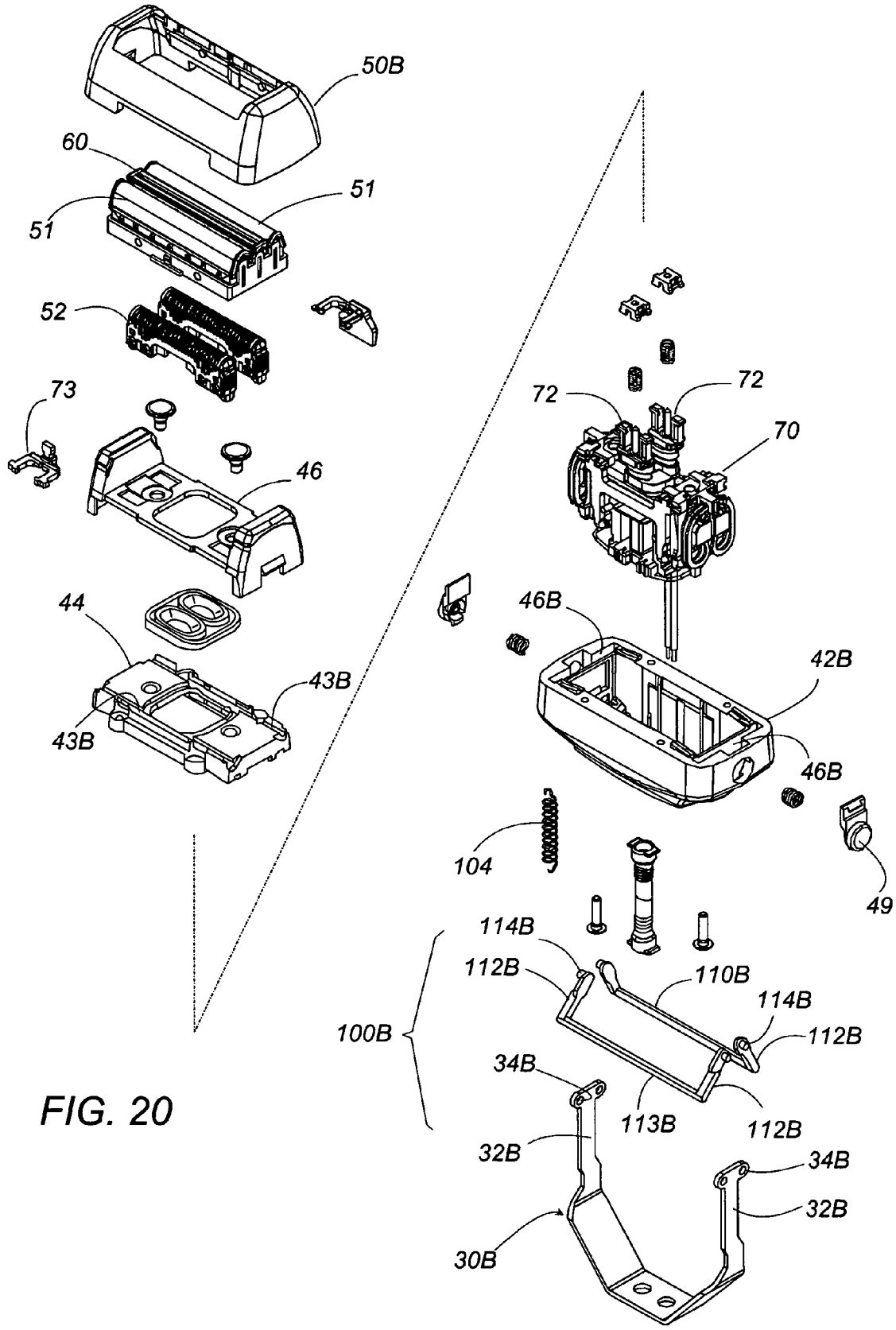
FIG. 20 is an exploded perspective view of the shaver.
Figure 23:
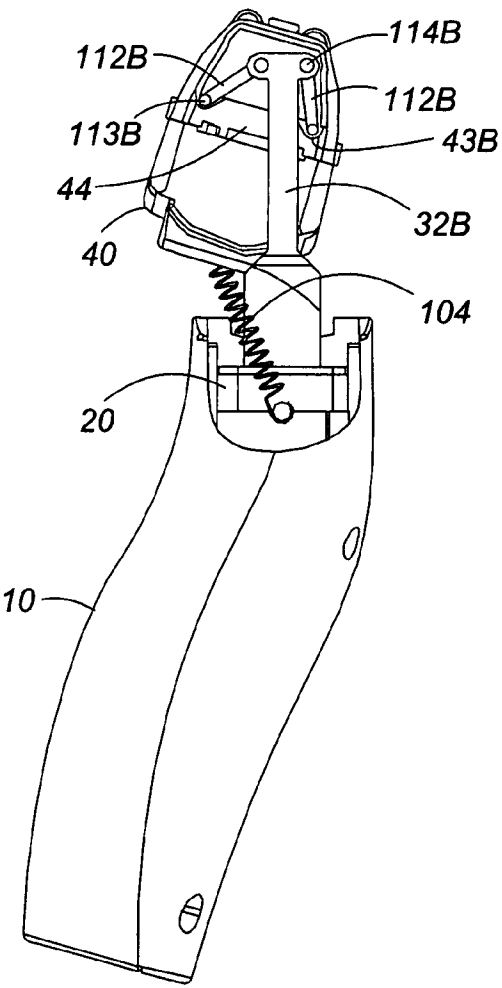
FIGS. 21 to 23 are schematic views respectively illustrating the shaving head in different positions.
Figure 22:
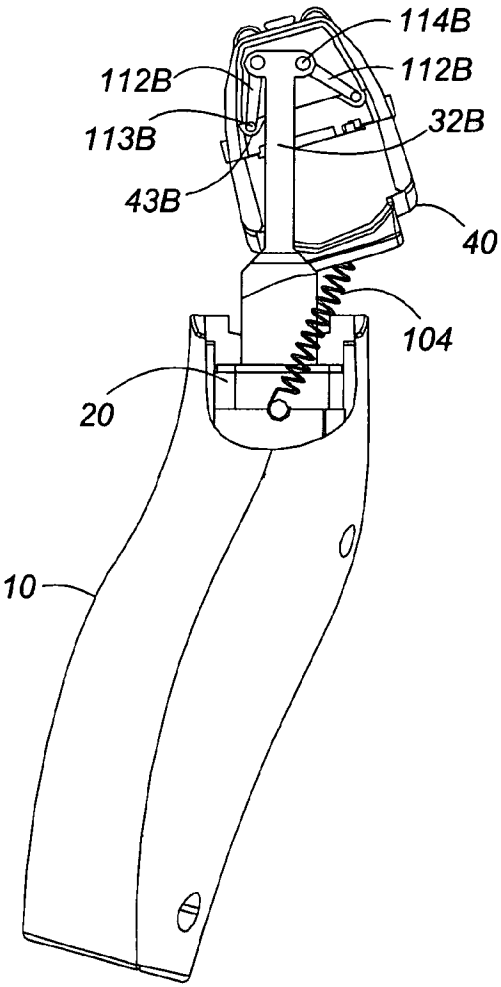
Figure 21:
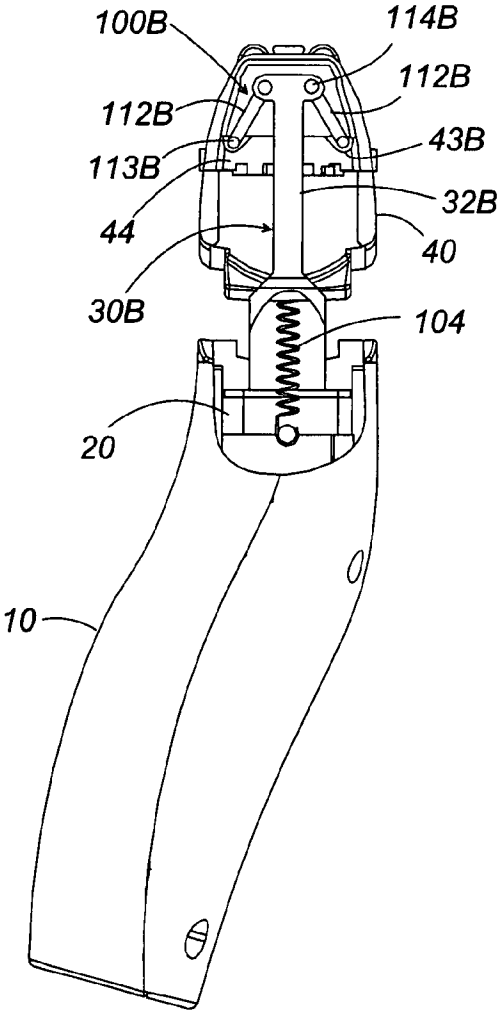

Referring to FIGS. 18 to 20, there is shown a dry shaver in accordance with a further embodiment of the present invention which is similar to the previous embodiment except that the shaving head 40 is arranged to swing about its width axis, rather than its thickness axis. Like parts are designated by like reference numerals for easy reference purpose. The shaving head 40 itself is basically identical to that explained hereinbefore, and includes a cradle case 42B and a shell 50B carrying two shearing foils 51 and a center cutting unit 60. A base 44 is secured within the case 42B upwardly of the major portion of the actuator 70 and has an opening through which the output shafts 72 extend. The shaving head 40B is supported to a frame 30B projecting on top of the grip 10 by means of a like linkage mechanism 100B having two cranks 110B each composed of side links 112B interconnected at their lower ends by a support axle 113B. The frame 30B is secured at its lower end with the slider 20 within the grip 10 to have props 32B projecting into slits 46B formed in the opposite lengthwise ends of the case 42B. The cranks 110B are disposed within the case 40B with their support axles 113B pivotally received within grooves 43B formed in the base 44 to give the support points spaced in the thickness direction. The side links 112B of each crank 110B are formed at their upper ends respectively with anchor pins 114B which fit respectively into pivot holes 34B at the upper ends of the props 32B so as to suspend the shaving head 40 on top of the grip 10 through the frame 30B, and to allow the shaving head 40 to swing about its width axis in a like manner as discussed in the previous embodiment. A coil spring 104 interconnects the case 42B and the frame 30B to give a spring bias which retains the shaving head 40 normally in an upright position of FIG. 21, and against which the shaving head swings to different positions of FIGS. 22 and 23.

Figure 26:
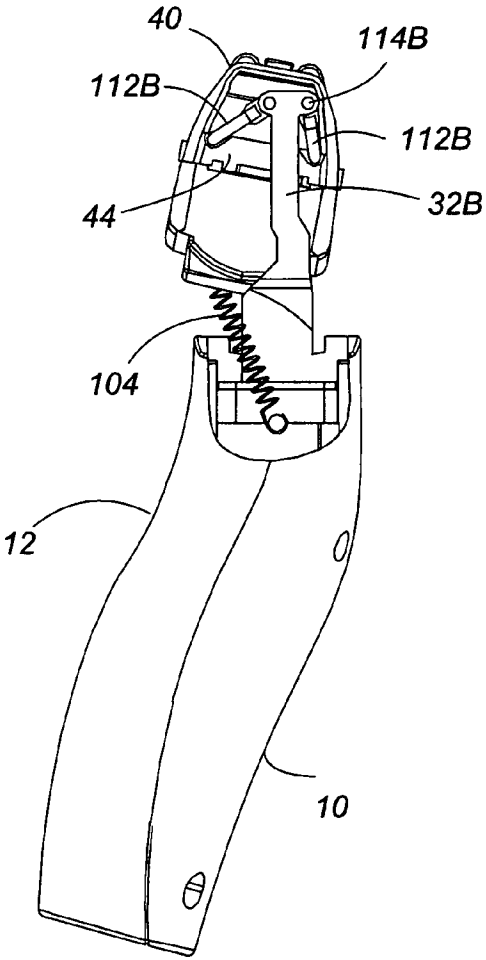
FIGS. 24 to 26 are schematic views respectively illustrating the shaving head in different positions in accordance with a modification of the above embodiment.
Figure 25:
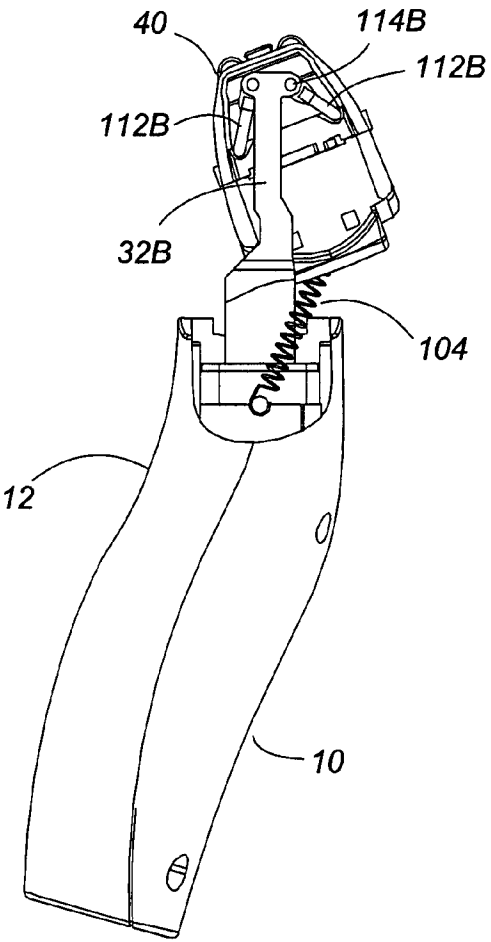
Figure 24:
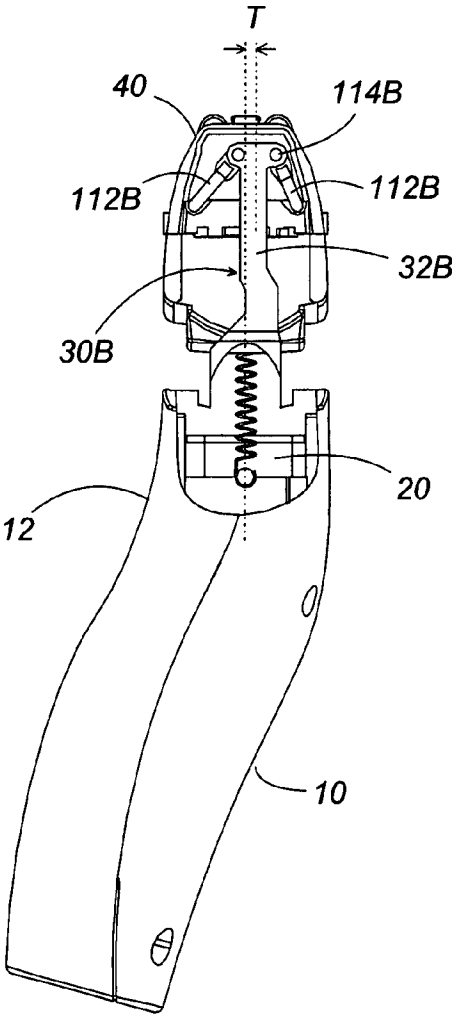

A modification of the above embodiment is illustrated in FIGS. 24 to 26 in which the props 32B of the frame 30B is offset rearwards by a distance of (T) in the thickness direction of the shaving head 40 with respect to a center vertical axis of the shaving head. In other words, the horizontal center between the anchor pins 114B is offset rearwards. The shaving head 40 is configured to have its mass center aligned with the center vertical axis. Thus, the above offset arrangement enables the shaving head 40 to swing to a forward direction with an assistance of a bias or moment caused by the weight of the shaving head, thereby swinging the shaving head to the forward direction at a force less than that required to swing it rearwards. In view of that the shaving head is normally utilized with the front face (the left-hand face in the figures) opposed to the user's face, the above offset arrangement can therefore enhance a convenience of manipulating the shaver across the user's skin. In the illustrated embodiment, the front face of the shaving head is determined in relation to a curved structure of the grip 10, that is, on the same side of the grip 10 with a recessed portion 12 upon which the thumb of the user is placed when grasping the grip.

The invention claimed is:

1. A dry shaver comprising:

a grip extending along a height axis;

a shaving head having a cutting face on its top and a cradle base at its bottom;

a frame assembly including a base frame member and a pair of prop members spaced- apart from one another and connected to the base frame member to define a generally U-shaped space between and among the base frame member and the pair of prop members, the frame assembly connected to the grip such that the pair of prop members project outwardly from the grip parallel to the height axis; and a linkage mechanism coupling said shaving head to said frame assembly for allowing said shaving head to swing relative to said grip;

wherein the generally U-shaped space receives the shaving head such that the cradle base of the shaving head is disposed adjacent the base frame member and between the pair of prop members;

wherein the linkage mechanism includes at least one U-shaped crank having a pair of side links spaced apart from one another and a crank base linking the pair of side links together in a manner to form a U-shaped configuration;

wherein each one of the pair of prop members has a distal prop end portion disposed opposite the base frame member and has at least one pivot hole formed therethrough to define an anchor point, and the cradle base has a pair of pivot grooves disposed apart from one another and formed into the cradle base, each pivot groove defining a support point; and wherein said support points are spaced from each other by a coupler distance (C) greater than a frame distance (F) between said anchor points.

2. The dry shaver as set forth in claim ,1 wherein said frame assembly includes a slider slidably connected to the grip and operative to slide along the height axis, the slider being spring-biased upwardly.

3. The dry shaver as set forth in claim 1, wherein said cutting face is elongated in a width direction of said shaving head.

4. The dry shaver as set forth in claim 1, wherein said cutting face is elongated in a width direction and narrowed in a thickness direction of said shaving head.

5. The dry shaver as set forth in claim 1, wherein respective ones of the pair of pivot grooves pivotably receives a respective one of the crank base links and respective ones of the distal prop end portions are pivotably connected to respective ones of the side links via respective ones of the pivot holes.

6. The dry shaver as set forth in claim 1, wherein said cranks are angled with each other at an angle of 30° to 120°.

7. The dry shaver as set forth in claim 1, wherein said coupler distance (C) is at least 1.5 times of said frame distance (F).

8. A dry shaver comprising:

a grip extending along a height axis;

a shaving head composed of a cradle case mounted on its top, an outer cutter, and an inner cutter; said cradle case accommodating therein an actuator connected to drive the inner cutter relative to the outer cutter, said cradle case having a cradle base at its bottom;

a pair of prop members projecting upwardly from the grip parallel to the height axis, said prop members being spaced-apart from one another to define a space therebetween;

a linkage mechanism configured to couple said shaving head to said prop members for allowing said shaving head to swing relative to said grip, wherein said space receives the shaving head such that the cradle base of the shaving head is disposed adjacent lower ends of said prop members between the pair of the prop members; and wherein said linkage mechanism includes a pair of cranks each pivotally connected at its upper end to upper ends of said prop members and pivotally connected at its lower end to said cradle base at the lower end of the cradle case such that the connection of each of said cranks with each of said prop members are located upwardly of the connection of each of said cranks with said cradle base along said height axis, and wherein:

(A) the pair of prop members defines anchor points at its upper end for pivotal connection respectively to said cranks, (B) said cradle case has in its bottom-with a pair of pivot grooves spaced apart from each other to define support points for pivotal connection respectively to said cranks, and (C) said support points are spaced from each other by a coupler distance (C) greater than a frame distance (F) between said anchor points.

9. The dry shaver as set forth in claim 8, wherein said shaving head is given a spring bias against which said shaving head swings relative to said grip.

10. The dry shaver as set forth in claim 8, wherein said coupler distance (C) is at least 1.5 times of said frame distance (F).

11. The dry shaver as set forth in claim 8, wherein said cranks are angled with each other at an angle of 30° to 120°.

12. The dry shaver as set forth in claim 8, wherein the upper end of the prop member is lower than the upper end of the shaving head.

* * * * *